US006899394B2

(12) United States Patent
Wang

(10) Patent No.: US 6,899,394 B2
(45) Date of Patent: May 31, 2005

(54) CHAIR WITH A RACK-AND-PINION ASSEMBLY FOR ADJUSTING HEIGHT OF A SEAT MEMBER

(75) Inventor: Jui-Lu Wang, Taipei (TW)

(73) Assignee: Mission Hills Investment Corporation, Cayman Islands (KN)

( * ) Notice: Subject to any disclaimer, the term of this patent is extended or adjusted under 35 U.S.C. 154(b) by 0 days.

(21) Appl. No.: 10/369,627

(22) Filed: Feb. 21, 2003

(65) Prior Publication Data

US 2004/0164601 A1 Aug. 26, 2004

(51) Int. Cl.[7] ..... A47C 1/02
(52) U.S. Cl. ..... 297/344.22; 297/344.2
(58) Field of Search ..... 297/344.12, 344.14, 297/344.2, 344.22; 248/157, 422, 354.7

(56) References Cited

U.S. PATENT DOCUMENTS

| | | | | |
|---|---|---|---|---|
| 482,233 A | * | 9/1892 | Rusin | 137/592 |
| 537,081 A | * | 4/1895 | Starkey | 248/422 |
| 2,599,610 A | * | 6/1952 | Clairmonte et al. | 248/157 |
| 5,445,432 A | * | 8/1995 | Chien | 297/344.18 |
| 6,050,643 A | * | 4/2000 | Kain et al. | 297/344.18 |
| 6,161,898 A | * | 12/2000 | Brevi | 297/328 |
| 6,302,482 B1 | | 10/2001 | Moll et al. | |

FOREIGN PATENT DOCUMENTS

| | | |
|---|---|---|
| DE | 719578 | 4/1942 |
| EP | 0726045 | 8/1996 |
| EP | 1 104 661 | 11/1999 |
| JP | 1-284247 | 11/1989 |

* cited by examiner

*Primary Examiner*—Peter M. Cuomo
*Assistant Examiner*—Stephen Vu
(74) *Attorney, Agent, or Firm*—Harness, Dickey & Pierce, P.L.C.

(57) ABSTRACT

A chair includes a seat member having left and right sides formed with left and right leg-holding seats, respectively. Each of the leg-holding seats defines a leg extension bore therethrough. Each of left and right leg units has an elongated front leg extending through the leg extension bore in a respective one of the leg-holding seats. Two racks are respectively fixed to and extend along the length of the front legs. A driven shaft is journalled to a bottom face of the seat member. Two pinions are respectively fixed to opposite ends of the driven shaft, and mesh respectively with the racks. A drive unit drives rotation of the driven shaft, which in turn, results in sliding movement of the seat member along the front legs.

7 Claims, 6 Drawing Sheets

CHAIR WITH A RACK-AND-PINION ASSEMBLY FOR ADJUSTING HEIGHT OF A SEAT MEMBER

BACKGROUND OF THE INVENTION

1. Field of the Invention

The present invention relates to a chair, more particularly to a chair with a rack-and-pinion assembly for adjusting the height of a seat member.

2. Description of the Related Art

A conventional chair generally includes a seat member having left and right sides, and left and right leg units disposed at the left and right sides of the seat member so as to support the seat member thereon.

The conventional chair is disadvantageous in that adjustment of the height of the seat member is manually conducted, which is inconvenient and laborious.

SUMMARY OF THE INVENTION

Therefore, the object of this invention is to provide a chair with a rack-and-pinion assembly which can facilitate adjustment of the height of a seat member.

According to the present invention, a chair includes: a seat member having a bottom face, and left and right sides formed with left and right leg-holding seats, respectively, each of the leg-holding seats defining a leg extension bore therethrough; left and right leg units, each of which has an elongated front leg extending through the leg extension bore in a respective one of the leg-holding seats so as to permit sliding movement of the seat member along the elongated front legs of the left and right leg units; a rack-and-pinion assembly including a pair of racks respectively fixed to and extending along the length of the elongated front legs of the left and right leg units, a driven shaft journalled to the bottom face of the seat member and having two opposite ends disposed respectively adjacent to the racks, and a pair of pinions respectively fixed to the opposite ends of the driven shaft and meshing respectively with the racks; and a drive unit for rotating the driven shaft, which in turn results in sliding movement of the seat member along the elongated front legs.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
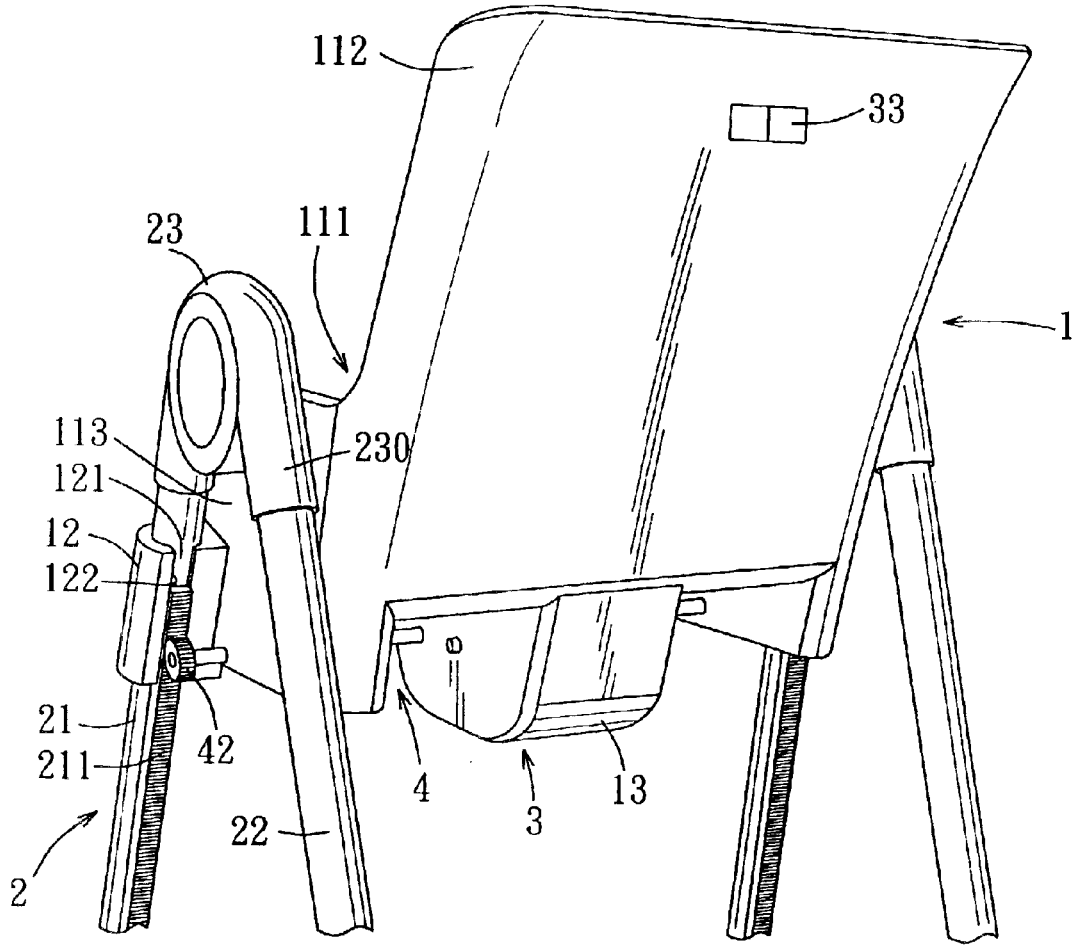
FIG. 1 is a rear perspective view of the first preferred embodiment of a chair according to the present invention.
Figure 2:
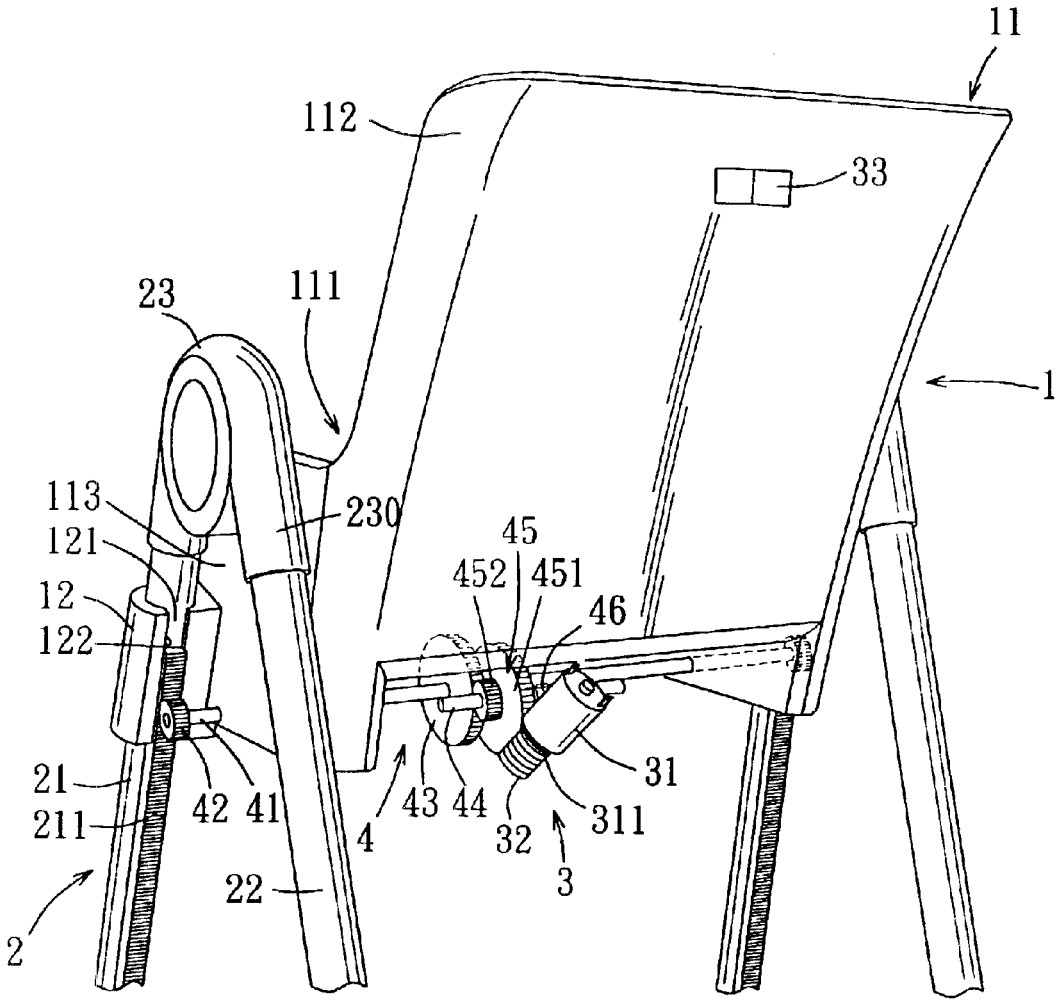
FIG. 2 is a rear perspective view of the first preferred embodiment, with a motor housing removed therefrom to illustrate how a driven shaft is connected to a motor through a drive shaft and a gear unit.
Figure 3:
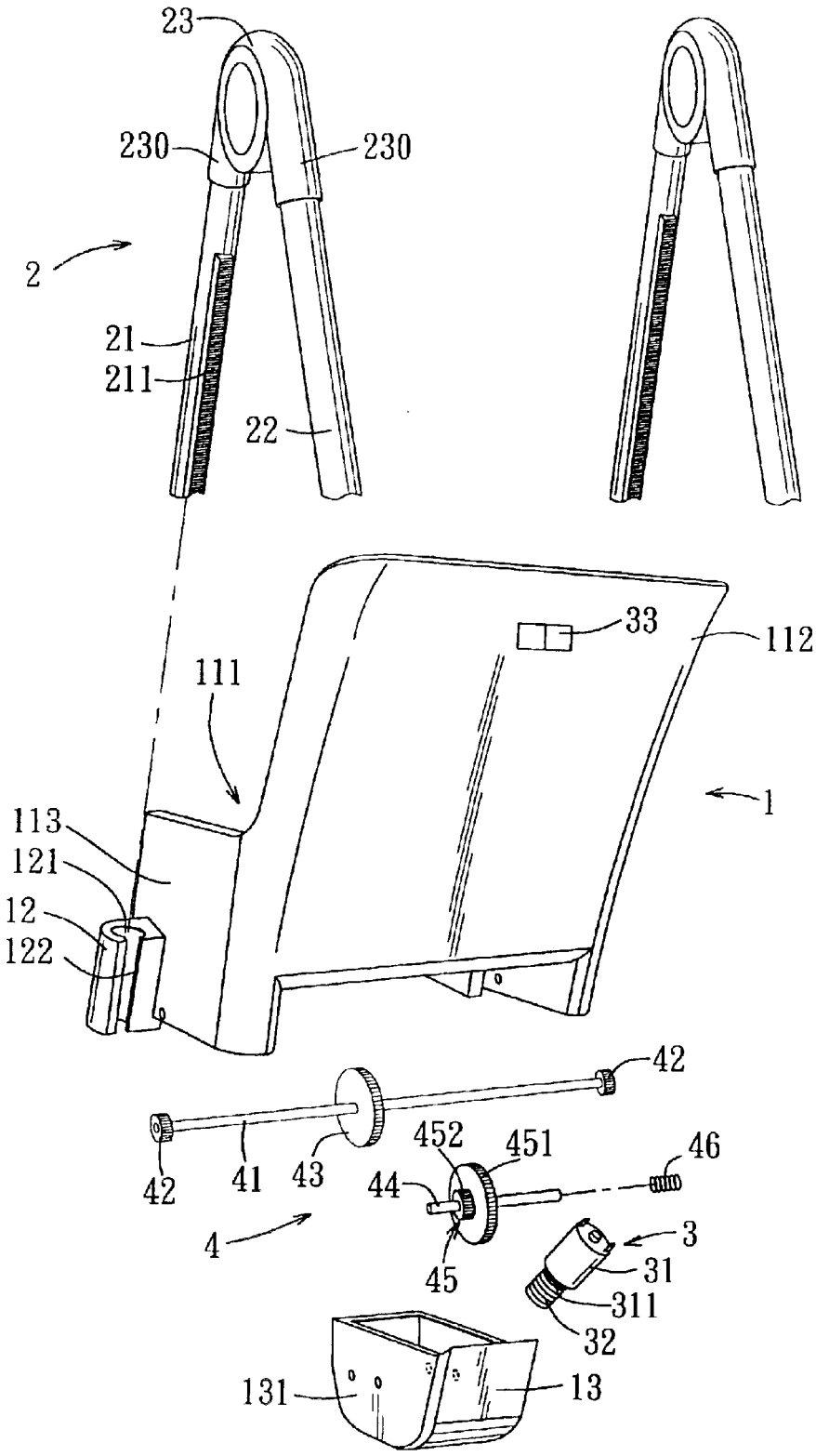
FIG. 3 is an exploded rear perspective view of the first preferred embodiment.
Figure 5:
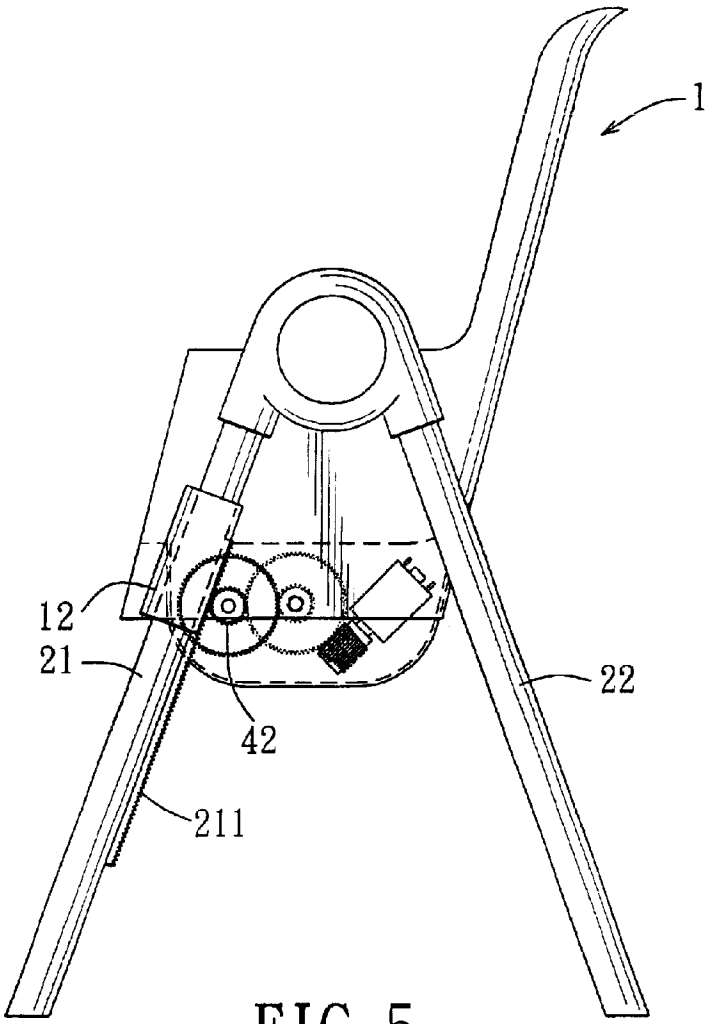
FIG. 5 is a schematic side view of the first preferred embodiment, showing a state prior to height adjustment.

Referring to FIGS. 1 to 5, the first preferred embodiment of a chair according to the present invention is shown to include a seat member 1, left and right leg units 2, a rack-and-pinion assembly 4, and a drive unit 3.

As illustrated, the seat member 1 has a seat portion 111 with left and right sides 113, and a backrest portion 112 extending upwardly from a rear end of the seat portion 111. The left and right sides 113 of the seat portion 111 are formed with left and right leg-holding seats 12, respectively. Each of the leg-holding seats 12 defines a leg extension bore 121 therethrough.

Each of the left and right leg units 2 has an elongated front leg 21 extending through the leg extension bore 121 in a respective one of the leg-holding seats 12 so as to permit sliding movement of the seat member 1 along the elongated front legs 21 of the left and right leg units 2.

The rack-and-pinion assembly 4 includes a pair of racks 211, a driven shaft 41, and a pair of pinions 42. The racks 211 are respectively fixed to and extend along the length of the elongated front legs 21 of the left and right leg units 2. The driven shaft 41 is journalled to a bottom face of the seat portion 111, and has two opposite ends disposed respectively adjacent to the racks 211. The pinions 42 are fixed to the opposite ends of the driven shaft 41, and mesh respectively with the racks 211.

The drive unit 3 is connected to and drives the driven shaft 41 to rotate, thereby resulting in sliding movement of the seat portion 111 along the elongated front legs 21.

In the first preferred embodiment, each of the leg-holding seats 12 further defines an axially extending rack-extension slot 122 that is in spatial communication with the leg-extension bore 121 and that permits extension of a respective one of the racks 211 therethrough. The pinions 42 are respectively disposed adjacent to the rack-extension slots 122 in the leg-holding seats 12 so as to engage the respective rack 211.

Figure 4:
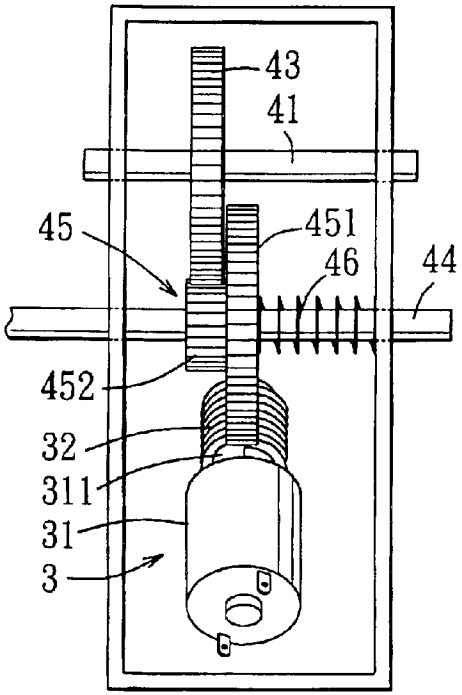
FIG. 4 is fragmentary schematic view of the preferred embodiment, illustrating connection among the drive and driven shafts and the gear unit.
Figure 6:
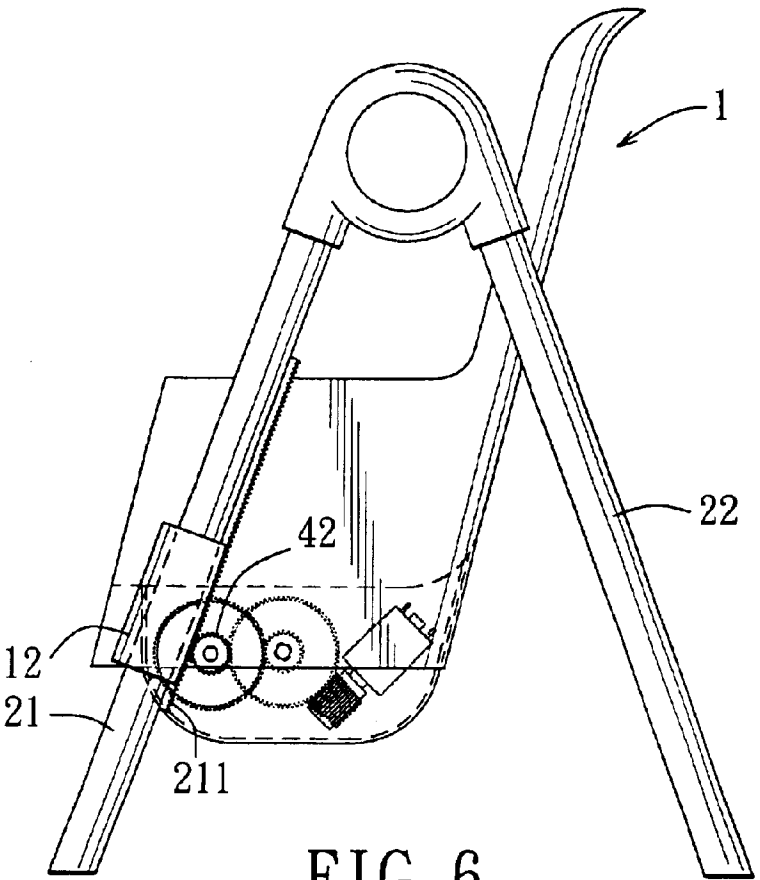
FIG. 6 is a schematic side view of the first preferred embodiment, showing a state after height adjustment.

The drive unit 3 preferably includes a motor housing 13, a drive shaft 44, a motor 31, a worm gear 32, and a speed reduction gear unit 45. The motor housing 13 is secured to the bottom face of the seat portion 111. The drive shaft 44 is journalled between two opposite side walls 131 of the motor housing 13, and is disposed rearwardly of the driven shaft 41. The motor 31, preferably a reversible motor for clockwise and counterclockwise revolutions, is mounted in the motor housing 13, and has an output shaft 311. The worm gear 32 is fixed to the output shaft 311. The speed reduction gear unit 45 includes a first gear 43 fixed to the driven shaft 41, a second gear 451 fixed to the drive shaft 44 and meshing with the worm gear 32, and a third gear 452 that is fixed to the drive shaft 44 and that meshes with the first gear 43. Accordingly, rotation of the output shaft 311 can be transmitted to the driven shaft 41 which, in turn, results in sliding movement of the seat member 1 along the elongated front legs 21. Note that the seat member 1 can be positioned at a desired height by the motor 31 upon deactivation of the motor 31. An urging member 46, preferably a compression spring, is sleeved on the drive shaft 44 for urging the second gear 451 and the third gear 452 to mesh constantly and respectively with the worm gear 32 and the first gear 43, as best shown in FIGS. 4 and 6.

A control switch 33 is mounted on the backrest portion 112 of the seat member 1, and is electrically connected to the motor 31 for controlling activation and deactivation of the motor 31 in a conventional manner.

Figure 7:
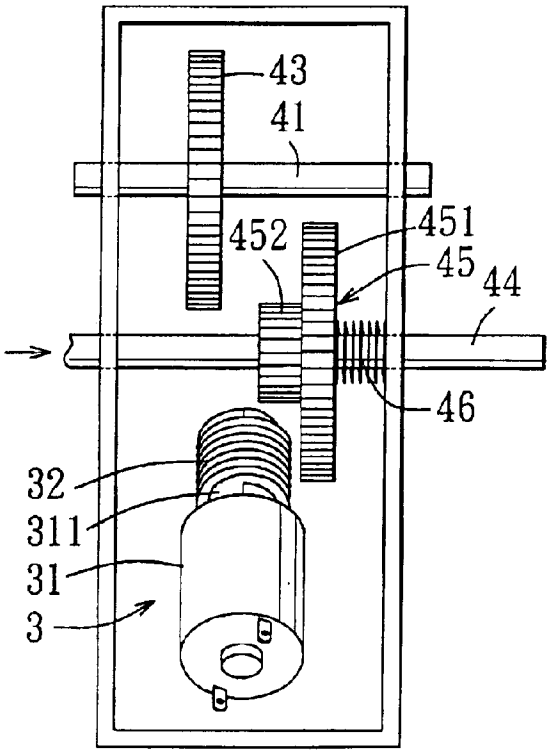
FIG. 7 is a fragmentary schematic view of the first preferred embodiment, illustrating the driven shaft when disconnected from the drive shaft.

In this embodiment, each of the elongated front legs 21 of the left and right leg units 2 has an upper end. Each of the left and right leg units 2 further includes an elongated rear leg 22 that is disposed rearwardly of the elongated front leg 21 and that has an upper end. The chair of the present embodiment further includes inverted V-shaped left and right leg coupling members 23 disposed above the elongated front and rear legs 21, 22. Each of the left and right leg coupling members 23 has front and rear downwardly opening tubular portions 230 that respectively receive the upper ends of the elongated front and rear legs 21, 22 of the respective one of the left and right leg units 2. When it is desired to disconnect the driven shaft 41 from the drive shaft 44, the drive shaft 44 can be pushed in the rightward direction, as indicated by the arrow in FIG. 7, against the urging action of the compression spring 46 so as to disengage the second gear 451 and the third gear 452 from the worm gear 32 and the first gear 43, respectively. Under this condition, the driven shaft 41 can be manually operated to result in sliding movement of the seat member 1 along the racks 211.

Figure 8:
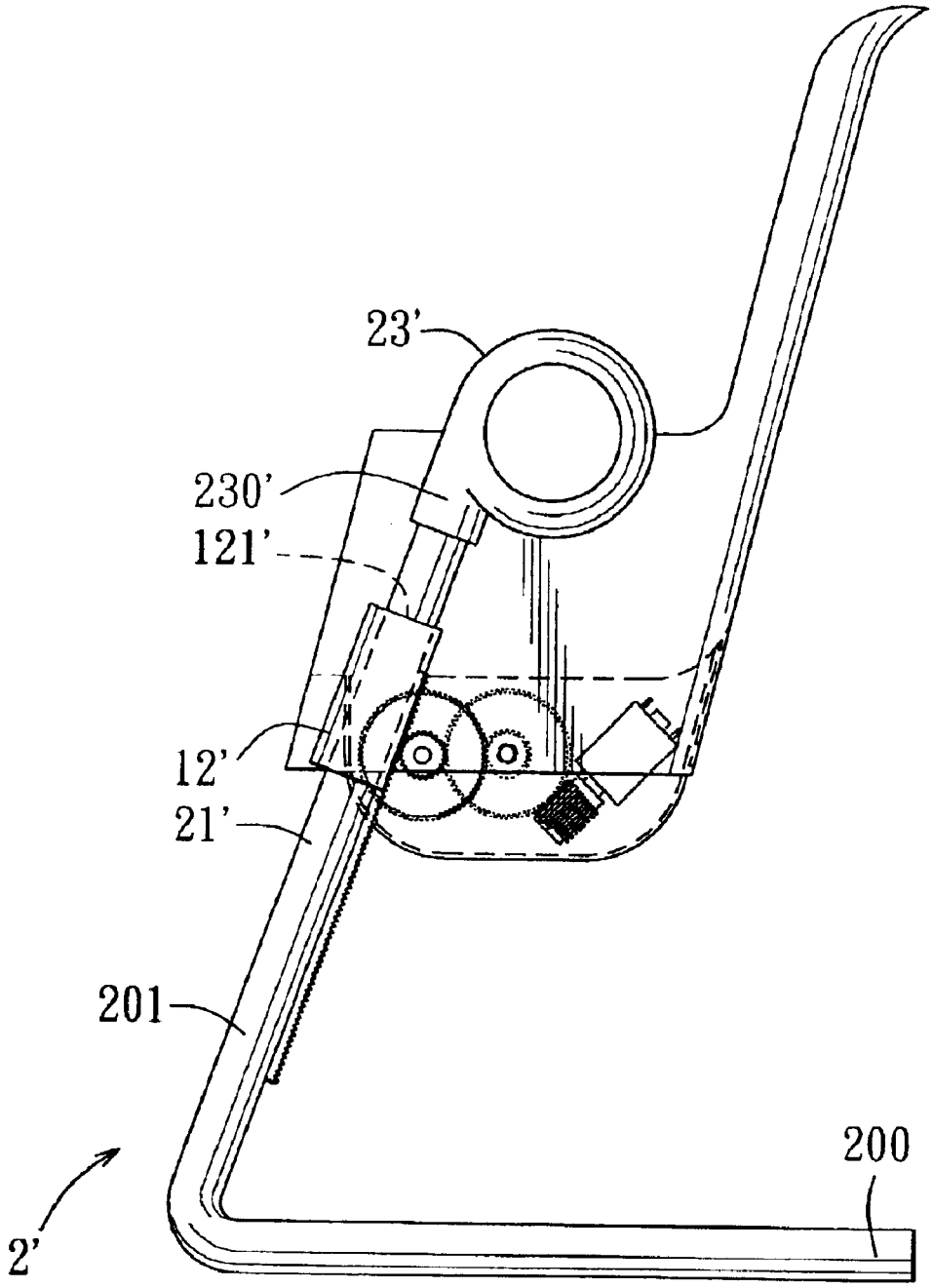
FIG. 8 is a schematic side view of the second preferred embodiment of a chair according to the present invention.

Referring to FIG. 8, the second preferred embodiment of a chair according to the present invention is shown to have a construction similar to that of the previous embodiment. The only difference resides in that each of the left and right leg units 2' (only one is visible in FIG. 8) is generally L-shaped, and has a horizontal portion 200 adapted to be laid on the ground surface, and an upright portion 201 extending uprightly from the horizontal portion 200 through the leg extension bore 121' in the respective one of the leg-holding seats 12' and defining the elongated front leg 21', respectively. Left and right leg coupling members 23' (only one is visible in FIG. 8) are disposed above the elongated front legs 21'. Each of the left and right leg coupling members 23' has a downwardly opening tubular portion 230' to receive the upper end of the elongated front leg 21' of the respective one of the left and right leg units 2'.

With the inclusion of the rack-and-pinion assembly 4 and the drive unit 3 in the chair of this invention, the aforesaid disadvantage of the prior art can be eliminated.

With this invention thus explained, it is apparent that numerous modifications and variations can be made without departing from the scope and spirit of this invention. It is therefore intended that the invention be limited only as indicated in the appended claims.

I claim:

1. A chair comprising:

a seat member having a bottom face, and left and right sides formed with left and right leg-holding seats, respectively, each of said leg-holding seats defining a leg extension bore therethrough, each of said left and right leg units having an elongated front leg extending through said leg extension bore in a respective one of said leg-holding seats so as to permit sliding movement of said seat member along said elongated front legs of said left and right leg units;

said left and right leg units connected to said seat member;

a rack-and-pinion assembly including a pair of racks respectively fixed to and extending along the length of said left and right leg units, a driven shaft mounted rotatably on said seat member and having two opposite ends disposed respectively adjacent to said racks, and a pair of pinions respectively fixed to said opposite ends of said driven shaft and meshing respectively with said racks; and a drive unit for driving said driven shaft, which in turn results in sliding movement of said seat member along said left and right leg units.

2. The chair as defined in claim 1, wherein each of said leg-holding seats further defines an axially extending rack-extension slot that is in spatial communication with said leg-extension bore and that permits extension of a respective one of said racks therethrough, said pinions being respectively disposed adjacent to said rack-extension slots in said leg-holding seats so as to engage respectively said racks.

3. The chair as defined in claim 1, wherein said drive unit includes a motor housing secured to said bottom face of said seat member, a drive shaft journalled to said motor housing and disposed rearwardly of said driven shaft, a motor mounted in said motor housing and having an output shaft, a worm gear fixed to said output shaft, and a speed reduction gear unit including a first gear fixed to said driven shaft, a second gear fixed to said drive shaft and meshing with said work gear, and a third gear that is fixed to said drive shaft and that meshes with said first gear for transmitting rotation of said drive shaft to said driven shaft.

4. The chair as defined in claim 3, wherein said drive unit further includes an urging member sleeve on said driven shaft for urging said second gear and said third gear to constantly mesh with said worm gear and said first gear, respectively.

5. The chair as defined in claim 3, wherein said drive unit further includes a control switch mounted on said seat member and electrically connected to said motor for controlling activation and deactivation of said motor.

6. The chair as defined in claim 1, wherein each of said elongated front legs of said left and right leg units has an upper end, each of said left and right leg units further including an elongated rear leg disposed rearwardly of said elongated front leg and having an upper end, said chair further comprising inverted V-shaped left and right leg coupling members disposed above said elongated front and rear legs of a respective one of said left and right leg units, each of said left and right leg coupling members having front and rear downwardly opening tubular portions to receive said upper ends of said elongated front and rear legs of the respective one of said left and right leg units.

7. The chair as defined in claim 1, wherein each of said elongated front legs of said left and right leg units has an upper end, each of said left and right leg units being generally L-shaped, and having a horizontal portion adapted to be laid on the ground surface, and an upright portion extending upright from said horizontal portion through said leg extension bore in the respective one of said leg-holding seats and defining said elongated front leg, said chair further comprising left and right leg coupling members disposed respectively above said elongated front legs of said left and right leg units, each of said left and right leg coupling members having a downwardly opening tubular portion to receive said upper end of said elongated front leg of the respective one of said left and right leg units.

* * * * *